US007813664B2

(12) United States Patent
Chae et al.

(10) Patent No.: US 7,813,664 B2
(45) Date of Patent: Oct. 12, 2010

(54) POWER CONTROL METHOD AND APPARATUS TO CONTROL A HEATING ROLLER

(75) Inventors: Young-min Chae, Suwon-si (KR); Sang-yong Han, Suwon-si (KR); Joong-gi Kwon, Gunpo-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 710 days.

(21) Appl. No.: 11/705,429

(22) Filed: Feb. 13, 2007

(65) Prior Publication Data

US 2007/0189796 A1 Aug. 16, 2007

(30) Foreign Application Priority Data

Feb. 16, 2006 (KR) ..... 10-2006-0015160

(51) Int. Cl.
*G03G 15/20* (2006.01)

(52) U.S. Cl. ..... 399/69; 399/88

(58) Field of Classification Search ..... 399/69, 399/70, 88

See application file for complete search history.

(56) References Cited

U.S. PATENT DOCUMENTS 5,682,576 A * 10/1997 Sakai et al. ..... 399/69
6,853,818 B2 * 2/2005 Nishida ..... 399/67
6,912,367 B2 * 6/2005 Miura ..... 399/69
7,146,117 B2 * 12/2006 Song et al. ..... 399/69
7,295,789 B2 * 11/2007 Inukai ..... 399/67

FOREIGN PATENT DOCUMENTS

JP 2005-258346 9/2005

OTHER PUBLICATIONS

Chinese Office Action dated Aug. 8, 2008 issued in CN 2007-10103553.X.

* cited by examiner

*Primary Examiner*—William J Royer
(74) *Attorney, Agent, or Firm*—Stanzione & Kim, LLP

(57) ABSTRACT

A power control method and apparatus to control a heating roller, the power control method including gradually increasing a maximum level of a source power supplied from an external source up to a specific maximum supply level, and supplying the source power to a heating resistor as a roller, power, measuring a surface temperature of the heating roller, and supplying the source power having a maximum level equal to the maximum supply level to the heating resistor as the roller power until the measured surface temperature reaches a specific fixing target temperature, supplying the source power having an upper limit of the maximum level equal to a specific fixing property improving level to the heating resistor as the roller power until a printing medium is first fed, and fixing a toner image of print data onto the fed printing medium by using the heating roller.

30 Claims, 8 Drawing Sheets

POWER CONTROL METHOD AND APPARATUS TO CONTROL A HEATING ROLLER

CROSS-REFERENCE TO RELATED APPLICATIONS

This application claims priority under 35 U.S.C. §119(a) from Korean Patent Application No. 10-2006-0015160, filed on Feb. 16, 2006, in the Korean Intellectual Property Office, the disclosure of which is incorporated herein in its entirety by reference.

BACKGROUND OF THE INVENTION

1. Field of the Invention

The present general inventive concept relates to a heating roller used to fix a toner image, and more particularly, to a power control method and apparatus to control a heating roller, to supply an external source power to a heating resistor included in the heating roller.

2. Description of the Related Art

In an image forming apparatus, such as a printer or a copy machine, which forms an image of print data on a printing medium by using a developing material, such as toner, a toner image corresponding to the print data is fixed onto the printing medium, and the printing medium is then discharged out of the image forming apparatus, thereby obtaining a printed matter.

The image forming apparatus may use a heating roller having heating resistors. In this case, in order to perform a fixing operation, a surface temperature of the heating roller has to be maintained around a fixing target temperature, for example, 180° C.

The image forming apparatus is switched to a print mode when the image forming apparatus first receives a printing order after power is on, or when the image forming apparatus receives the printing order in a standby mode. Here, a time required after the printing order is received and before a first printed matter is discharged is referred to a first print out time (FPOT). In order to reduce the FPOT of the image forming apparatus, including the heating roller, the surface temperature of the heating roller has to reach the fixing target temperature in a rapid manner.

FIGS. 1A-1C illustrate a power control principle of a conventional heating roller. If a resistance of a heating resistor is determined in proportion to a heating roller's temperature equal to or less than a threshold temperature, and a voltage (Vin) 110 illustrated in FIG. 1A is applied to the heating resistor, then a current (Ir) 120 illustrated in FIG. 1B flows through the heating resistor.

If the current (Ir) 120 is gradually decreased until the heating roller's temperature reaches the threshold temperature, the power control principle for the conventional heating roller has a drawback in that a circuit may be damaged due to an electric shock because an excessive current may flow through the heating resistor when power begins to be supplied to the heating resistor. In this case, a high current may flow through the heating roller in the form of an alternating current, thereby deteriorating a flicker characteristic. The flicker characteristic can be defined as a phenomenon in which power supplied to a peripheral circuit is temporarily weakened.

A threshold resistance that represents a resistance of a heating resistor at a threshold temperature is determined intrinsically. Here, the lower the threshold resistance is used, the more the power can be supplied to the heating resistor.

Thus, the surface temperature of the heating rollers can be rapidly increased. However, when a heating resistor having a lower threshold resistance is used, a higher current flows through the heating resistor when power begins to be supplied to the heating resistor, thereby causing the aforementioned problems. Eventually, in the conventional power control principle for a heating roller, a heating resistor has to have a sufficiently low threshold resistance, and thus, there has been a limit in reducing a time required for increasing a surface temperature of the heating roller up to a fixing target temperature STt.

Furthermore, if the image forming apparatus receives a printing order after the image forming apparatus is turned on, the heating roller can be heated after a control unit (not illustrated), which controls overall tasks performed in the image forming apparatus, for example, a central processing unit (CPU) of the image forming apparatus, is initialized. Therefore, the aforementioned problem that there is a limit in reducing a warm-up time for printing becomes more apparent when the image forming apparatus receives the printing order before the control unit (not illustrated) is initialized.

According to the conventional power control principle, as illustrated in FIG. 1C, a heating roller is heated until a surface temperature thereof reaches a fixing standby temperature STr, for example, 160° C., that is, during time t=t1~t2. In addition, after the surface temperature of the heating roller reaches the fixing target temperature STr, a pressure roller co-rotates with the heating roller until surface temperatures of the heating roller and the pressure roller reach the fixing target temperature STt, that is, during time t=t2~t3.

Meanwhile, during a time after the surface temperature of the heating roller reaches the fixing target temperature STt and before the image forming apparatus receives the printing order, that is, during time t=t3~t4, no power is supplied to the heating resistor. Further, if the image forming apparatus receives the printing order after the surface temperature of the heating roller reaches the fixing target temperature STt (t=t4), the heating roller is heated such that the surface temperature thereof is maintained at the fixing target temperature STt.

In this case, the surface temperature of the heating roller is not decreased right after the power stops to be supplied to the heating roller (t=t3+), but is increased up to a specific temperature STos, and thereafter is decreased. Likewise, the surface temperature of the heating roller is not increased right after the power begins to be supplied to the heating roller (t=t4+), but is decreased to a specific temperature, and thereafter is increased.

Accordingly, in the conventional power control principle for a heating roller, once the surface temperature of the heating roller reaches the fixing target temperature STt, a roller power is no longer supplied to the heating resistor. Thus, if a printing medium is fed a long time after the power stops to be supplied to the heating resistor, a toner image cannot be fixed onto the printing medium in a stable manner. This becomes more apparent when the printing medium is fed at a low temperature, such as, a room temperature.

SUMMARY OF THE INVENTION

The present general inventive concept provides a power control method in which, when the image forming apparatus is turned on, a heating roller can be heated before the image forming apparatus is initialized, power can be supplied to the heating roller in such a way that the power is gradually increased at an early stage, and a maximum power is provided after a specific time elapses, so that a flicker characteristic can be improved, and a surface temperature of the heating roller can rapidly reach a fixing target temperature.

The present general inventive concept also provides a power control apparatus for a heating roller performing the power control method above.

The present general inventive concept also provides a computer-readable medium having embodied thereon a computer program to execute the power control method above.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept are achieved by providing a power control method to control a heating roller, in which a roller power being supplied to a heating resistor included in the heating roller is controlled in an image forming apparatus using the heating roller to fix a toner image, the power control method including supplying a source power supplied from an external source to the heating resistor as the roller power while gradually increasing a maximum level of a source power up to a specific maximum supply level, measuring a surface temperature of the heating roller, and supplying the source power having a maximum level equal to the maximum supply level to the heating resistor as the roller power until the measured surface temperature reaches a specific fixing target temperature, supplying the source power having an upper limit of the maximum level at a specific fixing property improving level to the heating resistor as the roller power until a printing medium is first fed, fixing a toner image of print data onto the fed printing medium by using the heating roller.

The supplying of the source power supplied from the external source to the heating resistor as the roller power may begin to be performed right after the image forming apparatus is turned on, or right after the image forming apparatus is switched from a standby mode to a print mode.

The fixing property improving level may be less than the maximum supply level.

The foregoing and/or other aspects and utilities of the present general inventive concept are also achieved by providing a power control apparatus to control a heating roller, in which a roller power being supplied to a heating resistor included in the heating roller is controlled in an image forming apparatus using the heating roller and to fix a toner image, the power control apparatus including a power supply unit which gradually increases a maximum level of a source power supplied from an external source in response to a first or second warm-up indication signal, outputs the source power to the heating resistor as the roller power, outputs the source power having a maximum level equal to the maximum supply level to the heating resistor as the roller power in response to a third warm-up indication signal, and outputs the source power having an upper limit of the maximum level equal to the fixing property improving level to the heating resistor as the roller power in response to a fifth warm-up indicating signal, a temperature measuring unit which measures the surface temperature of the heating roller in response to the third warm-up indication signal, a toner fixing unit to feed the printing medium and to fix a toner image of given print data onto the fed printing medium by using the heating roller in response to a fixing indication signal, a first comparing unit which compares the increased maximum level with the maximum supply level, and generates the second or third warm-up indication signal according to the comparison result, a second comparing unit which compares the measured surface temperature with a specific fixing target temperature, and generates one of the third warm-up indication signal and the fixing indication signal according to the comparison result obtained by the second comparing unit, and a paper feed detecting unit which checks whether the printing medium is fed in response to the fixing indication signal, and generates the fifth warm-up indication signal in response to the check result, wherein the first warm-up indication signal is generated right after the image forming apparatus is turned on, or right after the image forming apparatus is switched from the standby mode to the print mode.

The foregoing and/or other aspects and utilities of the present general inventive concept are also achieved by providing a computer-readable medium having embodied thereon a computer program to execute a power control method to control a heating roller, in which a roller power being supplied to a heating resistor included in the heating roller is controlled in an image forming apparatus using the heating roller and fixing a toner image, the power control method including gradually increasing a maximum level of a source power supplied from an external source up to a specific maximum supply level, and supplying the source power to the heating resistor as the roller power, measuring a surface temperature of the heating roller, and supplying the source power having a maximum level equal to the maximum supply level to the heating resistor as the roller power until the measured surface temperature reaches a specific fixing target temperature, supplying the source power having an upper limit of the maximum level is equal to a specific fixing property improving level to the heating resistor as the roller power until a printing medium is first fed, and fixing a toner image of print data onto the fed printing medium by using the heating roller.

The foregoing and/or other aspects and utilities of the present general inventive concept are also achieved by providing a power control apparatus usable in an image forming apparatus, to control heating resistors of a heating roller to fix a toner image, the power control apparatus including a power supply unit to receive an external power source and supply a roller power to the heating resistors, a temperature measuring unit to measure a surface temperature of the heating roller, a first comparing unit to compare the roller power supplied to the heating resistors to a maximum supply level and to generate one of a second warm-up indication signal and a third warm-up indication signal, the second warm-up indication signal being generated if the roller power supplied is below the maximum supply level, and the third warm-up indication signal being generated if the roller power supplied is at the maximum supply level, and a second comparing unit to compare the measured surface temperature of the heating roller to a predetermined target fixing temperature, and to generate one of the third warm-up indication signal and a fixing indication signal, the third warm-up indication signal being generated if the measured surface temperature of the heating roller is less than the target fixing temperature, and the fixing indication signal being generated if the measured surface temperature of the heating roller is at the target fixing temperature, wherein the power supply unit gradually increases a maximum level of the source power supplied as the roller power in response to one of a first warm-up indication signal and the second warm-up indication signal, the first warm-up indication signal being generated after one of a first power on of the image forming apparatus and a switch of the image forming apparatus from a standby mode to a print mode, supplies the roller power at a current maximum level of the source power in response to one of the third warm-up indication signal and the fixing indication signal, and does not supply roller power to the heating resistors in response to a power interruption indication signal, the power interruption indication signal being generated when the image forming apparatus is in standby mode.

The power control apparatus may further include a toner fixing unit, comprising the heating roller and a pressure roller, to co-rotate the heat and pressure rollers in response to a fourth indication signal, and to feed a printing medium and to fix the toner image on the printing medium in response to the fixing indication signal, wherein the fourth indication signal is generated after the image forming apparatus recognizes the pressure roller, and the toner fixing unit does not respond to the fixing indication signal if the image forming apparatus has not received a printing order.

The power control apparatus may further include a paper feed detecting unit to detect whether [the printing medium is fed and to generate a fifth warm-up indication signal if the printing medium is not fed in response to the fixing indication signal, wherein the power supply unit supplies the source power as the roller power at a fixing property improving level to the heat resistors in response to the fifth warm-up indication signal.

The power supply unit may be controlled by a first unit separate from one or more second control units to control the paper feed detecting unit and the toner fixing unit in the image forming apparatus.

The power supply unit may supply the roller power in response to one of the first, second, and third warm-up indication signals, the fixing indication signal, and the power interruption indication signal before the one or more second control units are initialized.

The image forming apparatus may switch from the standby mode to the print mode after receiving a printing order.

The foregoing and/or other aspects and utilities of the present general inventive concept are also achieved by providing a power control apparatus usable in an image forming apparatus, to control a heating roller to fix a toner image, the power control apparatus including a power supply unit to receive an external power source and supply a roller power to the heating roller, and a temperature measuring unit to measure a surface temperature of the heating roller, wherein the power supply unit performs one of gradually increasing a maximum level of the source power supplied as the roller power, supplying the roller power at a current maximum level of the source power, and not supplying roller power to the heating roller according to a measured level of the roller power supplied and a surface temperature of the heating roller.

The power supply unit may be controlled by a first control unit separate from one or more second control units to initialize the image forming apparatus.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figures 1A, 1B, 1C:
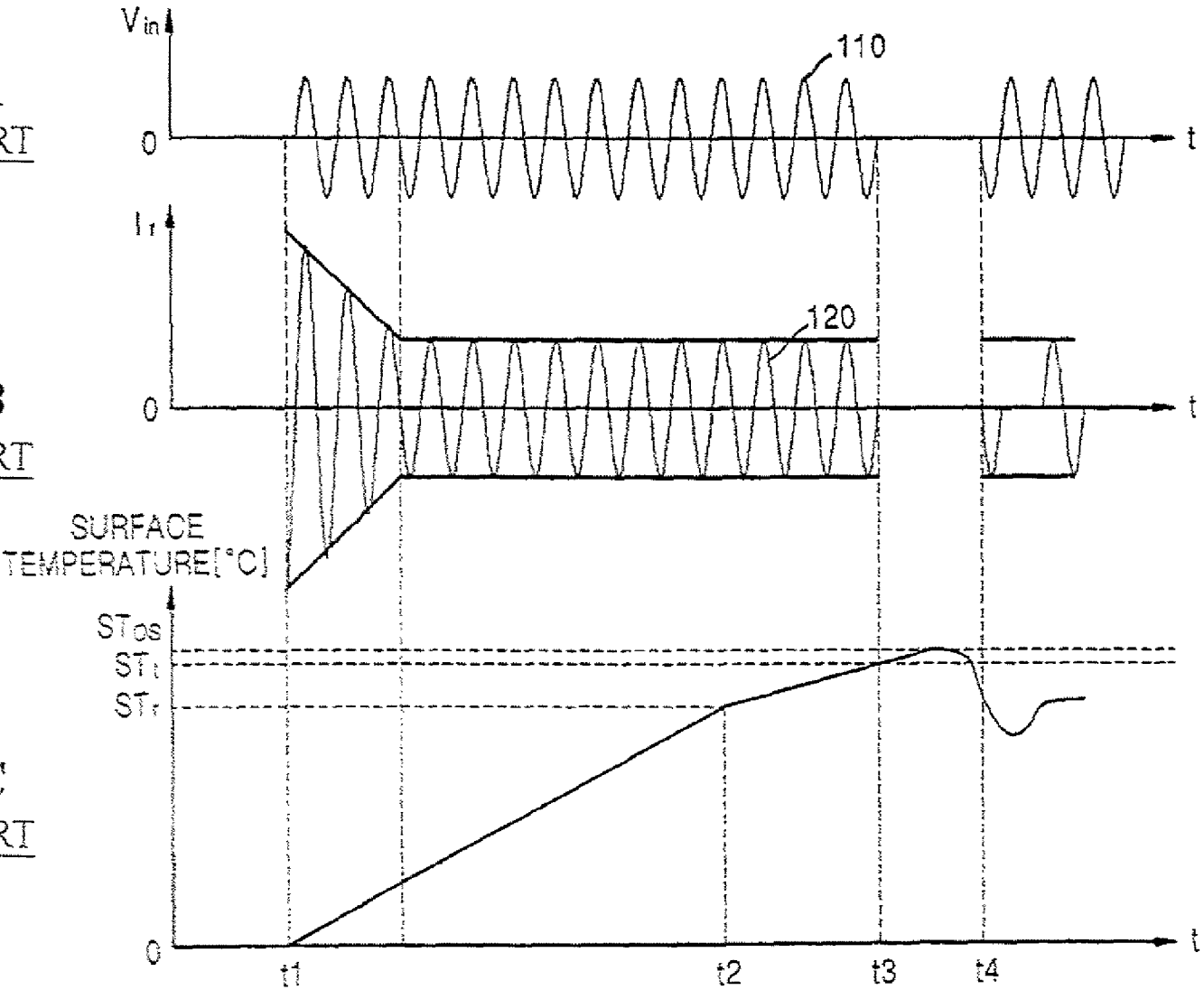
FIG. 1A RELATED ART
FIG. 1B RELATED ART
FIG. 1C RELATED ART
FIGS. 1A-1C illustrate a power control principle of a conventional heating roller.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Figure 2:
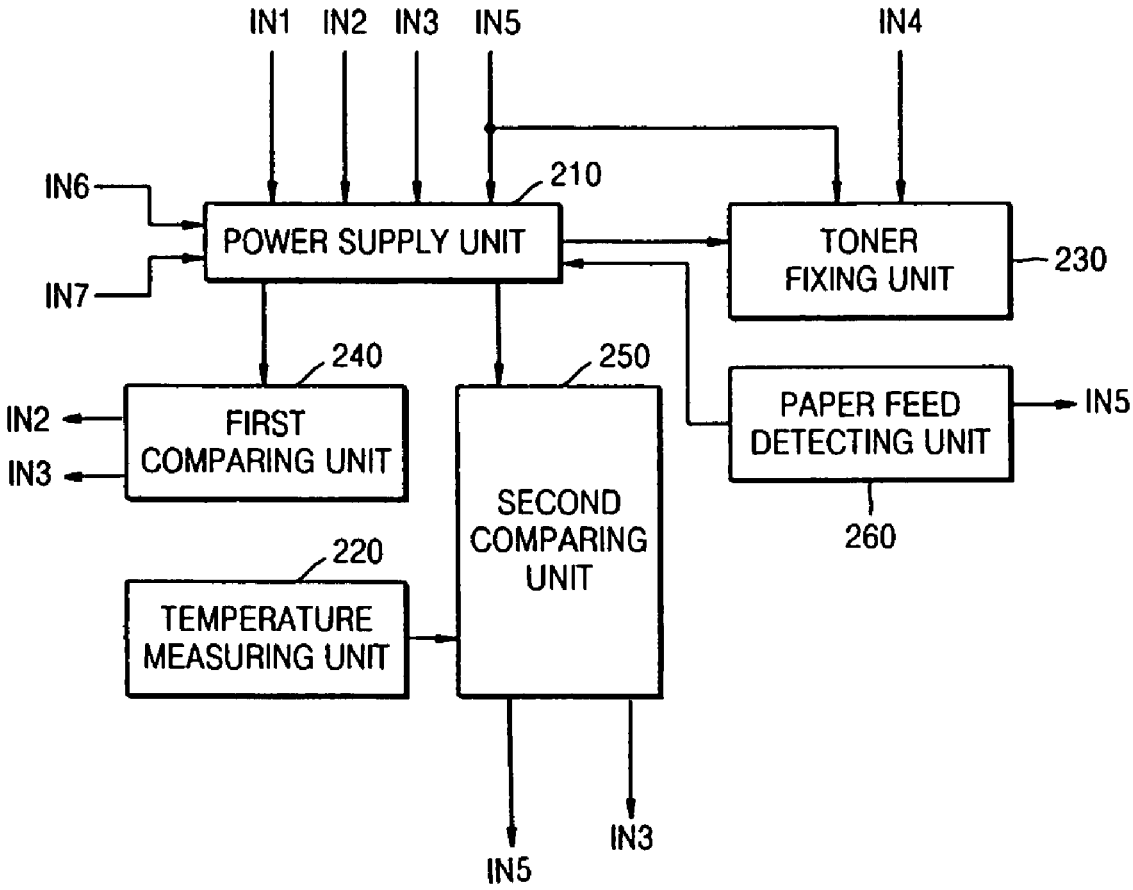
FIG. 2 is a block diagram illustrating a power control apparatus used to control a heating roller according to an embodiment of the present general inventive concept.

FIG. 2 is a block diagram illustrating a power control apparatus used to control a heating roller according to an embodiment of the present general inventive concept. The power control apparatus may include a power supply unit 210, a temperature measuring unit 220, a toner fixing unit 230, a first comparing unit 240, a second comparing unit 250, and a paper feed detecting unit 260.

All of the above units, 210 to 260, can be provided in an image forming apparatus to fix a toner image, for example, a fixing system of a laser printer or copy machine. The image forming apparatus may include a heating roller having one or more lamps.

Each lamp may include at least one heating resistor. The heating resistor can be made of tungsten, and may have a variable characteristic in which a resistance thereof is determined in proportion to (or in inverse proportion to) a heating resistor's temperature equal to or less than a threshold temperature. When the resistance is determined in proportion to the heating resistor's temperature equal to or less than the threshold temperature, the heating resistor may have a positive temperature coefficient (PTC) characteristic. For convenience, it will be assumed that the heating resistor has the PTC characteristic.

A plurality of lamps included in the heating roller, that is, a plurality of heating resistors, may be connected in parallel. A roller power that is supplied to the heating resistor may be controlled independently for each heating resistor.

The roller power may be supplied to the heating resistor in the form of an alternating current (AC), since an AC roller voltage and an AC roller current are applied. Here, the roller voltage represents a voltage applied to the heating resistor, and the roller current represents a current flowing through the heating resistor.

The power control apparatus may control the heating resistors in response to a plurality of indication signals received. For example, in response to a first or second warm-up indication signal, the power supply unit 210 may gradually increase a maximum level of a source power, and output the source power to the heating resistor as the roller power. Further, in response to a fifth warm-up indication signal, the power supply unit 210 may gradually increase the maximum level of the source power having an upper limit equal to a specific fixing property improving level and output the source power to the heating resistor as the roller power. Further, in response to a third warm-up indication signal or a fixing indication signal, the power supply unit 210 may output a source power input from an external source having the same maximum level to the heating unit as the roller power. Meanwhile, no power may be output to the heating roller as the roller power by the power supply unit 210 in response to a power supply interruption signal. In this description, the external source may represent a source outside the heating resistor, in particular, outside the power supply unit 210. In addition, the source power may represent a power that is input from the external source by the power supply unit 210, that is, a power input to the power supply unit 210. In addition, the roller power represents power that is supplied to the heating resistor via the power supply unit 210. For example, the source power can be input through an input node IN7.

The temperature measuring unit 220 may measure a surface temperature of the heating roller in response to the third warm-up indication signal, and output the measured surface temperature.

The toner fixing unit can allow the heating roller to co-rotate with a pressure roller in response to a fourth warm-up indication signal. Further, if print data is provided to an image forming apparatus, and the image forming apparatus is instructed to print the print data, the toner fixing unit 230 can feed a printing medium in response to the fixing indication signal. Here, feeding a printing medium means that the printing medium is supplied between the heating roller and the pressure roller. In addition, co-rotating means that, when the heating roller (or pressure roller) rotates, the pressure roller (or heating roller) also rotates in conjunction with the heating roller (or pressure roller).

In addition, in response to the fixing indication signal, the toner fixing unit 230 can fix a toner image of the print data onto the fed printing medium by using the heating roller and the pressure roller. Here, the print data is included in one or more sheets of printing medium, and the toner image is fixed for every sheet of printing medium.

For example, the toner fixing unit 230 can include the heating roller and the pressure roller, and the pressure roller can co-rotate with the heating roller in response to the fourth warm-up signal. As a result, a surface temperature of the pressure roller and a surface temperature of the heating roller can reach a fixing target temperature to be described later. In response to the fixing indication signal, the printing medium can be supplied between the heating roller and the pressure roller which co-rotate with each other. Not only the providing of the printing medium, but also the rotation of the heating and pressure rollers may be performed in response to the fixing indication signal. As described above, the toner image is fixed onto the supplied printing medium while the heating roller and the pressure roller rotate, and the printing medium is discharged out of the image forming apparatus as a printed matter.

While in the description above the power control apparatus is described in reference to first through fifth indication signals, fixing indication signals, and power interrupting indication signals, the present general inventive concept is not limited thereto, and the control method may include a different number of indication signals to accomplish the present general inventive concept. Hereinafter, the first to fifth warm-up indication signals, the fixing indication signal, and the power supply interruption signal described above will be described in detail.

The first warm-up indication signal is input through an input node IN1. The first war up indication signal represents a signal to the power supply unit 210 to increase a maximum level of an input source power and to supply the source power to the heating resistor as the roller power. The first warm-up indication signal can be generated right after the image forming apparatus is turned on, or right after the image forming apparatus is switched from a stand-by mode to a print mode. To achieve this, a control unit (not illustrated, hereinafter referred to as a heating control unit), which controls an operation related to heating the image forming apparatus, and another control unit (not illustrated, hereinafter referred to as non-heating control unit), which controls other operations in the image forming apparatus apart from the heating-related operation controlled by the heating control unit (hereinafter referred to as operations not-related to heating), can be separately included in the image forming apparatus. Here, a heating-related operation represents an operation having a correlation with respect to a heating operation in a degree of equal to or greater than a predetermined correlation. The higher the predetermined correlation, the more desirable it is.

For example, the heating control unit (not illustrated) may recognize the heating roller, or may control heating of the heating roller. The first warm-up indication signal may be generated by the heating control unit (not illustrated). Meanwhile, the non-heating control unit (not illustrated) may recognize the pressure roller, control rotation of the heating roller and the pressure roller, and control a laser scanning unit (LSU) included in the image forming apparatus.

The non-heating control unit (not illustrated) may be a central processing unit (CPU) of the image forming apparatus. The CPU controls other operations performed by the image forming apparatus apart from the heating-related operation.

Accordingly, since the control unit of the image forming apparatus may separately include the heating control unit (not illustrated) and the non-heating control unit (not illustrated) to control the operations performed by the image forming apparatus, when the image forming apparatus is turned on, the image forming apparatus can perform a heating operation to control the heating roller even before the CPU has been initialized.

The heating control unit and the non-heating control unit may be distinguished in a hardware or software manner.

The second warm-up indication signal can be input through an input node IN2. The second warm-up indication signal may represent a signal to the power supply unit 210 to increase a maximum level of the input source power and to supply the source power to the heating resistor as the roller power, and can be generated through the first comparing unit 240.

The third warm-up indication signal can be input through an input node IN3. The third warm-up indication signal may represent a signal to the power supply unit 210 to supply a source power having a maximum level equal to a maximum supply level to the heating resistor as the roller power, and can be generated through the first comparing unit 240 or the second comparing unit 250.

The fourth warm-up indication signal can be input through an input node IN4. The fourth warm-up indication signal may represent a signal to the heating roller to co-rotate with the pressure roller, and can be generated through the non-heating control unit after the non-heating control unit (not illustrated) of the image forming apparatus recognizes the pressure roller.

The fifth warm-up indication signal can be input through an input node IN5. The fifth warm-up indication signal may represent a signal to the power supply unit 210 to increase a maximum level of an input source power having an upper limit equal to the fixing property improving level and to supply the source power to the heating resistor as the roller power, and can be generated through the paper feed detecting unit 260.

The fixing indication signal can be input through an input node IN5. Further, the fixing indication signal may represent a signal to the power supply unit 210 to supply a source power having a maximum level equal to a thermostat level to the heating resistor as the roller power, and can be generated through the second comparing unit 250, or can be generated by the non-heating control unit (not illustrated) while a fixing operation is performed.

The power supply interruption signal can be input through an input node IN6. Here, the power supply interruption signal may represent a signal to the power supply unit 210 not to supply any roller power to the heating resistor, and can be generated while the image forming apparatus is in the standby mode. The power supply interruption signal can be generated right after the image forming apparatus is switched to the standby mode until the image forming apparatus is switched from the standby mode to the print mode. Accordingly, no roller power is supplied to the heating resistor included in the heating roller of the image forming apparatus in the standby mode. The power supply interruption signal may be generated by the heating control unit (not illustrated) or the non-heating control unit (not illustrated).

While the description above describes the different signals being input through respective input nodes, the present general inventive concept is not limited thereto, and the different signals may share input nodes or use a different number of input nodes. Hereinafter, the generation of the second, third, and fifth warm-up indication signals and the fixing indication signal will be described along with operations of the first comparing unit 240, the second comparing unit 250, and the paper feed detecting unit 260.

The first comparing unit 240 compares the maximum level of the source power that is increased as above and is input from the power supply unit 210 with a predetermined maximum supply level, and generates the second warm-up indication signal and the third warm-up indication signal according to the comparison result. The maximum supply level can be equal to a maximum level of the roller power that can be supplied to the heating resistor.

Specifically, if the increased maximum level above is less than the maximum supply level, the first comparing unit 240 generates the second warm-up signal. On the other hand, if the increased maximum level above reaches the maximum supply level, the first comparing unit 240 generates the third warm-up signal.

The second comparing unit 250 compares a surface temperature measured by the temperature measuring unit 220 with a fixing target temperature, for example, 180° C., and generates the third warm-up indication signal and the fixing indication signal according to the comparison result. The fixing target temperature represents a surface temperature of the heating roller at which a toner image can be fixed in a stable manner. Here, the surface temperature may be any temperature in the range between a minimum fixable temperature and a maximum fixable temperature. The fixing target temperature can be predetermined in the range between the minimum fixable temperature and the maximum fixable temperature.

Specifically, if the surface temperature measured by the temperature measuring unit 220 is less than the fixing target temperature, the second comparing unit 250 generates the third warm-up indication signal. On the other hand, if the surface temperature measured by the temperature measuring unit 220 reaches the fixing target temperature, the second comparing unit 250 generates the fixing indication signal.

The paper feed detecting unit 260 checks whether the printing medium is fed in response to the fixing indication signal, and generates the fifth warm-up indication signal in response to the check result. Specifically, if the printing medium is not fed in response to the fixing indication signal, the paper feed detecting unit 260 generates the fifth warm-up indication signal.

For example, if the image forming apparatus has not received a printing order after the image forming apparatus is turned on, the toner fixing unit 230 does not respond to the fixing indication signal, and thus the toner fixing unit 230 does not feed the printing medium. In this case, the paper feed detecting unit 260 generates the fifth warm-up indication signal, and the power supply unit 210 supplies a source power to the heating resistor as the roller power in response to the fifth warm-up indication signal, so that the surface temperatures of the heating roller and the pressure roller can be prevented from decreasing to less than the minimum fixable temperature until the printing medium receives the printing order.

The aforementioned power supply unit 210, the temperature measuring unit 220, the first comparing unit 240, the second comparing unit 250, and the paper feed detecting unit 260 may operate under the control of the heating control unit (not illustrated), and the toner fixing unit 230 may operate under the control of the non-heating control unit (not illustrated).

Figures 3A, 3B:
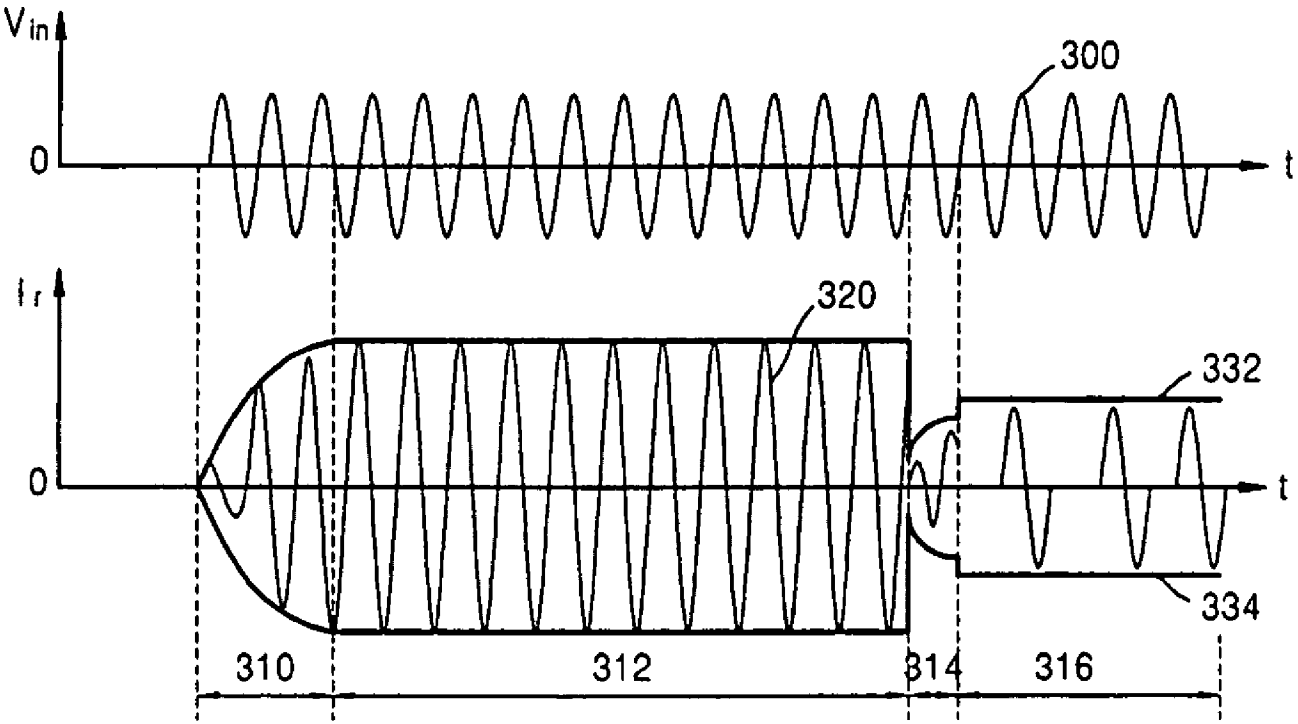
FIGS. 3A, 3B, and 4 are waveform diagrams illustrating a power control principle to control a heating roller according to an embodiment of the present general inventive concept.

A timing diagram of an exemplary source voltage 300 is illustrated in FIG. 3A. Further, a timing diagram of an exemplary roller current 320 is illustrated in FIG. 3B.

Referring to FIGS. 3A and 3B, some or all of the source voltage (Vin) 300 in the form of a sinusoidal wave generated by a source voltage generating unit (not illustrated) can be applied to a heating resistor having a temperature characteristic in which resistance increases in proportion to a temperature, and thus a roller current (Ir) 320 flows to the heating roller. For this, the power supply unit 210 inputs some or all of the source voltage 300 from the source voltage generating unit (not illustrated), and outputs the input source voltage 300 to the heating resistor as the roller voltage.

Here, the source voltage 300, the roller voltage, and the roller current 320 have a waveform in the form of alternating current. As a result, as described above, the source power and the roller power also have a waveform in the form of alternating current. Specifically, between envelopes 332 and 334 of the roller current 320, envelopes of the source power and the roller power have the same shape of the positive envelope 332.

The waveform of the roller current 320 flowing through the heating resistor can be divided into four sections which are: a flicker characteristic improving section 310, a maximum power supplying section 312, a fixing property improving section 314, and a fixing section 316.

In the flicker characteristic improving section 310, the power supply unit 210 operates in response to the first or second warm-up indication signal. Specifically, in the flicker characteristic improving section 310, the power supply unit 210 can gradually increase the maximum level of the source power up to the maximum supply level, and supply the source power to the heating resistor as the roller power. The roller voltage applied to the heating resistor until the maximum level of the source power reaches the maximum supply level is a portion of the source voltage 300.

In the maximum power supplying section 312, the power supply unit 210 operates in response to the third warm-up indication signal. Specifically, in the maximum power supplying section 312, the power supply unit 210 supplies the source power having a maximum level equal to the maximum supply level to the heating resistor as the roller power. The source voltage 300 is entirely applied to the heating resistor as the roller voltage in the maximum power supplying section 312.

In the fixing property improving section 314, the power supply unit 210 operates in response to the fifth warm-up indication signal. Specifically, in the fixing property improving section 314, the power supply unit 210 gradually increases the maximum level of the source power equal to the fixing property improving level, and supplies the source power to the heating resistor as the roller power. The fixing property improving level may be less than the maximum supply level, in particular, equal to or less than the thermostat level. The roller voltage applied to the heating roller in the fixing property improving section 314 is a portion of the source voltage 300.

In the fixing section 316, the power supply unit 210 and the toner fixing unit 230 operate in response to the fixing indication signal. Specifically, in the fixing section 316, the power supply unit 210 supplies the source power having a maximum level equal to the thermostat level to the heating resistor as the roller power, and the toner fixing unit 230 fixes the toner image onto the printing medium by using the heating roller in which the source power having a maximum level equal to the thermostat level is provided as the roller power. The roller voltage applied to the heating resistor in the fixing section 316 is a portion of the source voltage 300.

The surface temperature of the heating roller above has a specific similarity with respect to the fixing target temperature. For example, the surface temperature can be in the range of 95%~105% of the fixing target temperature. Here, the surface temperature is between the minimum fixable temperature and the maximum fixable temperature.

If the print data is included in a small amount of sheets of paper, for example, two sheets of paper, the surface temperature may not decrease to less than the minimum fixable temperature until the toner image of the print data is not entirely fixed, even though the roller power is no longer supplied to the heating roller of which surface temperature reaches the fixing target temperature. In this case, unlike in the previous description, the power supply unit 210 may not supply the source power having a maximum level equal to the thermostat level to the heating resistor as the roller power, and the toner fixing unit 230 may fix the toner image in a stable manner even though the roller power is not additionally provided in the fixing property improving section 314.

On the other hand, if the print data is included in a large amount of sheets of paper, for example, tens of sheets of paper, the surface temperature may decrease to less than the minimum fixable temperature before the toner image of the print data is entirely fixed, when though the roller power is no longer supplied to the heating roller of which surface temperature reaches the fixing target temperature. In this case, as described above, the power supply unit 210 has to supply the source power having a maximum level equal to the thermostat level to the heating resistor as the roller power.

The roller power may be supplied to each of heating resistors included in the heating roller in the flicker characteristic improving section 310, the maximum power supplying section 312, and the fixing property improving section 314. Alternatively, the roller power may be supplied to a selected heating resistor alone among all the heating resistors in the fixing section 316.

For example, the heating resistor is selected by the non-heating control unit (not illustrated), and the heating control unit periodically or non-periodically changes the selected heating resistor. In the fixing section 316, a time required for the roller current 320 to flow represents a time range required for the heating resistor itself to be selected by the non-heating control unit (not illustrated).

Figure 4:
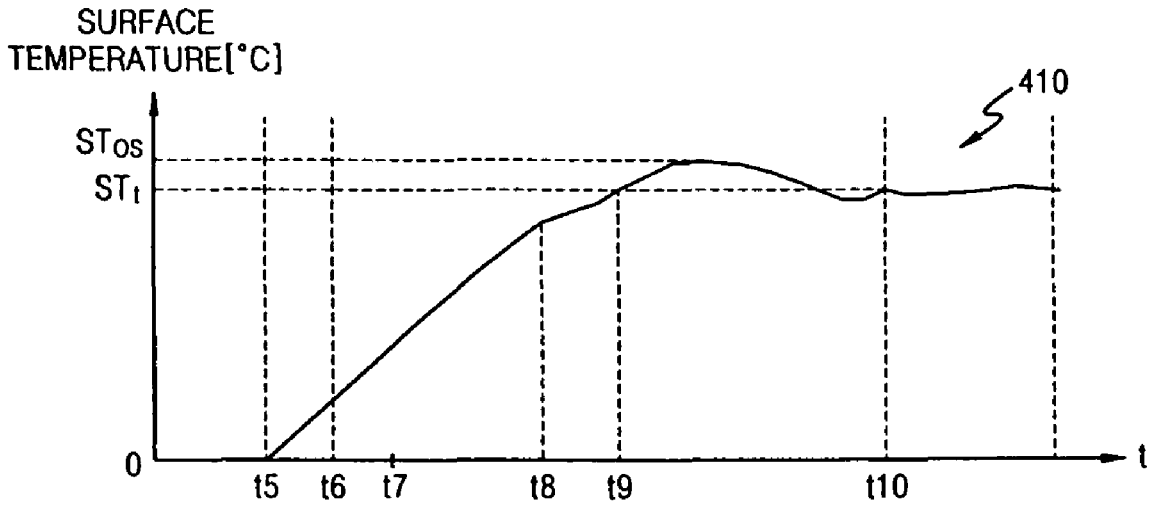

FIG. 4 is a timing diagram 410 illustrating a surface temperature of a heating roller. Now, the necessity of heating a surface of the pressure roller, a method of fixing a toner image onto a first fed printing medium in a more stable manner, and the changes in the surface temperature of the heating roller will be described with reference to FIG. 4.

If only the surface temperature of the heating roller is equal to the fixing target temperature, and the surface temperature of the pressure roller is a low temperature less than the minimum fixable temperature, and the printing medium is provided to be fixed in this state, the heating roller loses its heat to the pressure roller, and thus the surface temperature of the heating roller may be decreased to a temperature less than the minimum fixable temperature. In this case, the toner image cannot be fixed onto the printing medium in a stable manner, thereby deteriorating image quality of the printed matter.

In order to fix the toner image onto the printing medium in a stable manner, the surface temperature of the heating roller and the surface temperature of the pressure roller have to be increased to a fixing target temperature STt. To achieve this, the pressure roller has to co-rotate with the heating roller and has to take the heat of the heating roller. This is because the pressure roller does not have the heating resistor unlike the heating roller.

The pressure roller may begin to co-rotate with the heating roller so as to increase the surface temperature thereof right after the surface temperature of the heating roller reaches the fixing target temperature STt. That is, a section where the surface temperature is increased while the pressure roller co-rotates with the heating roller may be the fixing property improving section 314 of FIGS. 3A and 3B.

In this case, the pressure roller begins to co-rotate with the heating roller after the surface temperature of the heating roller reaches the fixing target temperature STt, and thus the surface temperature of the heating roller may be decreased to be less than the minimum fixable temperature. However, when the heating roller continues to receive the roller power, the surface temperature of the heating roller and the surface temperature of the pressure roller reach to the fixing target temperature STt. Accordingly, the fixing section 316 comes right after the surface temperature of the heating roller and the surface temperature of the heating roller reach the fixing target temperature STt.

Alternatively, the pressure roller may begin to co-rotate with the heating roller so as to increase the surface temperature thereof before the surface temperature of the heating roller reaches the fixing target temperature STt. That is, a section where the surface temperature is increased while the pressure roller co-rotates with the heating roller may be the maximum power supplying section 312.

In this case, the pressure roller begins to co-rotate with the heating roller before the surface temperature of the heating roller reaches the fixing target temperature STt, in particular, the heat control unit (not illustrated) recognizes the heating roller. As a result, the surface temperature of the heating roller and the surface temperature of the pressure roller rise to the fixing target temperature STt faster than when the pressure roller co-rotates with the heating roller. Accordingly, the fixing property improving section 314 comes right after the surface temperature of the heating roller and the surface temperature of the heating roller reach the fixing target temperature STt. In the timing diagram 410, the surface temperature of the heating roller rises in the maximum power supplying section 312 while the pressure roller co-rotates with the heating roller.

This will now be described in detail. Referring to FIG. 4 and FIGS. 3A and 3B, a time interval (t5~t6−) corresponds to the flicker characteristic improving section 310, a time interval (t6+~t9−) corresponds to the maximum power supplying section 312, a time interval (t9~t10) corresponds to the fixing property improving section 314, and a time interval (t10+) corresponds to the fixing section 316. Meanwhile, a time interval (t5~t7−) may correspond to a section where the non-heating control unit (not illustrated) is initialized, and a time interval (t7+~t9−) may correspond to a section where the image forming apparatus is initialized except for the non-heating control unit. The process of initializing the image forming apparatus except for the non-heating control unit includes the process in which the non-heating control unit (not illustrated) recognizes the pressure roller included in the image forming apparatus. The non-heating control unit (not illustrated) recognizes the pressure roller included in the image forming apparatus at t8.

Right after the image forming apparatus is turned on, or right after the image forming apparatus is switched from the standby mode to the print mode (t=5+), the heat control unit (not illustrated) recognizes the heating roller, and instructs the power supply unit 210 to supply a power to the heating resistor.

The pressure roller can co-rotate with the heating roller right after the heating roller is recognized by the non-heating control unit (not illustrated), regardless of whether the surface temperature of the heating roller reaches the fixing target temperature STt. Accordingly, the surface temperature of the pressure roller rises starting from t=t8, and thus the surface temperature of the heating roller less rapidly rises at a section of t=8+~9 than a section of t=0~t8−. Here, t8 may be included in the maximum power supplying section 312 as illustrated in FIG. 4. In addition, unlike in FIG. 4, t8 may be included in the flicker characteristic improving section 310.

The surface temperature of the heating roller and the surface temperature of the pressure roller reach the fixing target temperature STt at t=t9. The source power having a maximum level equal to the maximum supply level is supplied to the heating roller as the roller power only when t=t9.

If the source power having a maximum level equal to the thermostat level is supplied to the heating resistor as the roller power starting from t=t9+, the fixing property improving section 314 may not be provided in the present general inventive concept.

On the other hand, if the source power having a maximum level equal to the thermostat level is supplied to the heating roller as the roller power after t=t9+ (i.e. t=t10), a section of t=t9+~t10− becomes the fixing property improving section 314.

The fixing property improving section 314 will now be described with reference to FIG. 4. The second comparing unit 250 generates the fixing indication signal starting from t=t9+, and the paper feed detecting unit 260 checks whether the printing medium is fed in response to the fixing indication signal. Referring to FIG. 4, the image forming apparatus may not receive a printing order until t=t10, and thus the printing medium is not fed in the range of t=t9~t10−. As a result, the paper feed detecting unit 260 generates the fifth warm-up indication signal during t=t9~t10−, and the power supply unit 210 gradually increases the maximum level of the source power having a upper limit equal to the fixing property improving level in response to the fifth warm-up indication signal, and supplies the source power to the heating resistor as the roller power. Accordingly, during t=t9~t10−, the surface temperature of the heating roller does not decrease much from the fixing target temperature STt.

Figure 5:
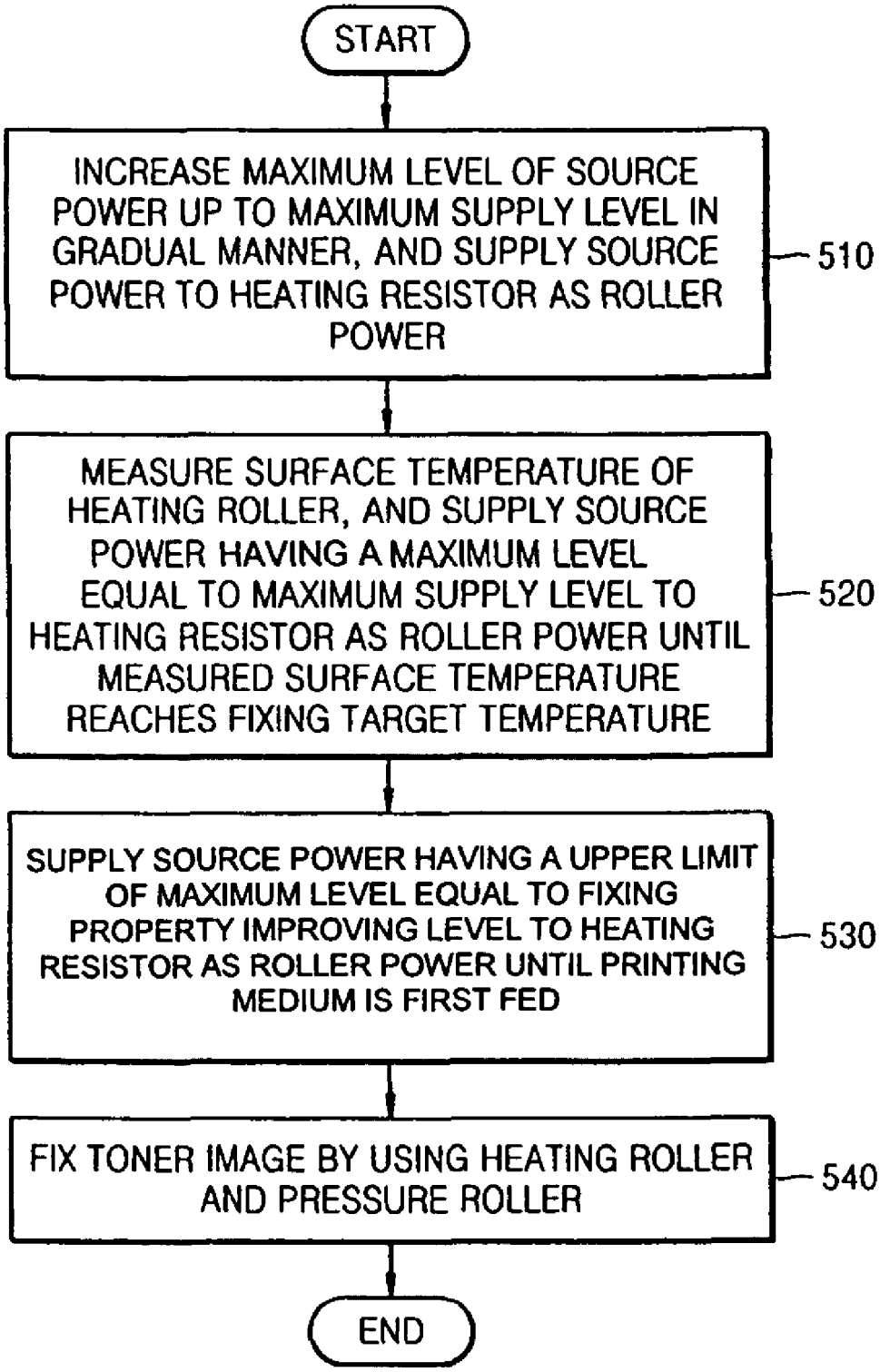
FIG. 5 is a flowchart illustrating a power control method to control a heating roller according to an embodiment of the present general inventive concept.

FIG. 5 is a flowchart illustrating a power control method to control a heating roller according to an embodiment of the present general inventive concept. The method includes operations (operations 510 to 540) which improve a flicker characteristic and allows the surface temperature of the heating roller to rapidly reach the fixing target temperature, by supplying the roller power to the heating resistor in a different manner with respect to the flicker characteristic improving section 310, the maximum power supplying section 312, and the fixing property improving section 314 and the fixing section 316.

The power supply unit 210 gradually increases the maximum level of the source power up to a specific maximum supply level, and supplies the source power to the heating resistor as the roller power (operation 510). Operation 510 may be performed right after the image forming apparatus is turned on, or right after the image forming apparatus is switched from the standby mode to the print mode.

After operation 510, the temperature measuring unit 220 measures the surface temperature of the heating roller, and the power supply unit 210 supplies the source power having a maximum level equal to the maximum supply level to the heating resistor as the roller power until the measured surface temperature reaches a specific fixing target temperature (operation 520).

After operation 520, the power supply unit 210 supplies the source power having an the upper limit of the maximum level equal to the fixing property improving level to the heating resistor as the roller power until the printing medium is first fed (operation 530).

Specifically, the power supply unit 210 gradually increases the maximum level of the source power having an upper limit equal to the fixing property improving level until the printing medium is first fed, and then supplies the source power to the heating resistor as the roller power. If the image forming apparatus is instructed to print the print data before operation 520 is ended, operation 530 may not be included in the power control method of the present general inventive concept. On the other hand, if the image forming apparatus is not instructed to print the print data until operation 520 is ended, operation 520 may be included in the power control method of the present general inventive concept.

To achieve this, the heating control unit (not illustrated) determines whether the image forming apparatus is instructed to print the print data, right after operation 520 is ended. In this case, if it is determined that the image forming apparatus is yet instructed to print the print data, the power supply unit 210 performs operation 530. On the other hand, if it is determined that the image forming apparatus is instructed to print the print data, the power supply unit 210 and the toner fixing unit 230 may perform operation 540.

However, if operation 530 is performed for a longer time than a standby mode determining time, the heating control unit (not illustrated) may instruct the power supply 210 to stop operation 530, and may switch the image forming apparatus to the standby mode.

After the operation 520 or 530, the power supply unit 210 supplies the source power having a maximum level equal to the thermostat level to the heating resistor, and the toner fixing unit 230 fixes the toner image of the print data onto the printing medium by using the heating roller and the pressure roller (operation 540).

The operations 510 to 530 can be controlled by the heating control unit (not illustrated), and the operation 540 can be controlled by the non-heating control unit (not illustrated). The operations 510, 520, 530, and 540 correspond to the flicker characteristic improving section 310, the maximum power supplying section 312, the fixing property improving section 314, and the fixing section 316, respectively.

After operation 540, the non-heating control unit (not illustrated) determines whether the print data is received while the standby mode determining time elapses after operation 540 is performed, and if it is determined that the print data is not received while the standby mode determining time elapses after operation 540 is performed, the image forming apparatus is switched to the standby mode.

In this case, the non-heating control unit (not illustrated) determines whether the print data is received after the image forming apparatus is switched to the standby mode. If it is determined that the print data is received after the image forming apparatus is switched to the standby mode, the image forming apparatus is switched to the print mode, and the power supply unit 210 is instructed to perform operation 510.

Figure 6:
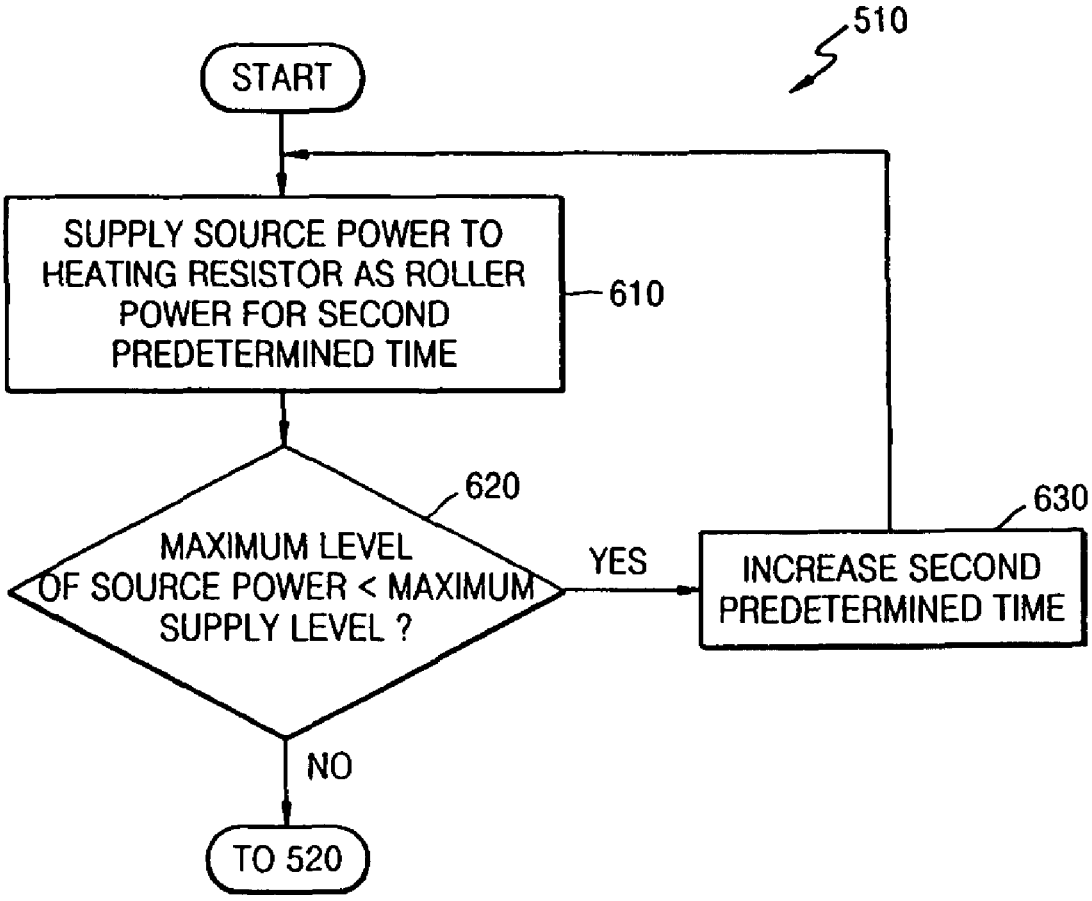
FIG. 6 is a flowchart illustrating operation 510 of the power control method of FIG. 5 according to an embodiment of the present general inventive concept.

FIG. 6 is a flowchart illustrating the operation 510 of FIG. 5 according to an exemplary embodiment of the present general inventive concept. In operations 610 to 630, the maximum level of the source power is gradually increased up to the maximum supply level, and the source power is supplied to the heating resistor as the roller power.

The power supply unit 210 supplies the source power to the heating resistor as the roller power during a second predetermined time at every first predetermined time (operation 610). The first predetermined time is equal to or greater than the second predetermined time. After operation 610, the first comparing unit 240 determines whether the maximum level of the source power supplied in operation 610 is less than the maximum supply level (operation 620).

If it is determined to be less in operation 620, the first comparing unit 240 instructs the power supply unit 210 to increase the second predetermined time, to increase the maximum level of the source power, and to allow the power supply unit 210 to re-perform operation 610 (operation 630).

On the other hand, if it is not determined to be less in operation 620, operation 520 is performed.

The second predetermined time is increased, as the maximum level of the source power approximates to the maximum supply level. Accordingly, a flicker characteristic becomes weakened, which may occur when the roller power is excessively supplied to the heating resistor at a point where the image forming apparatus is turned on or where the image forming apparatus is switched from the standby mode to the print mode, and thus the power is supplied to the heating resistor.

Figure 7:
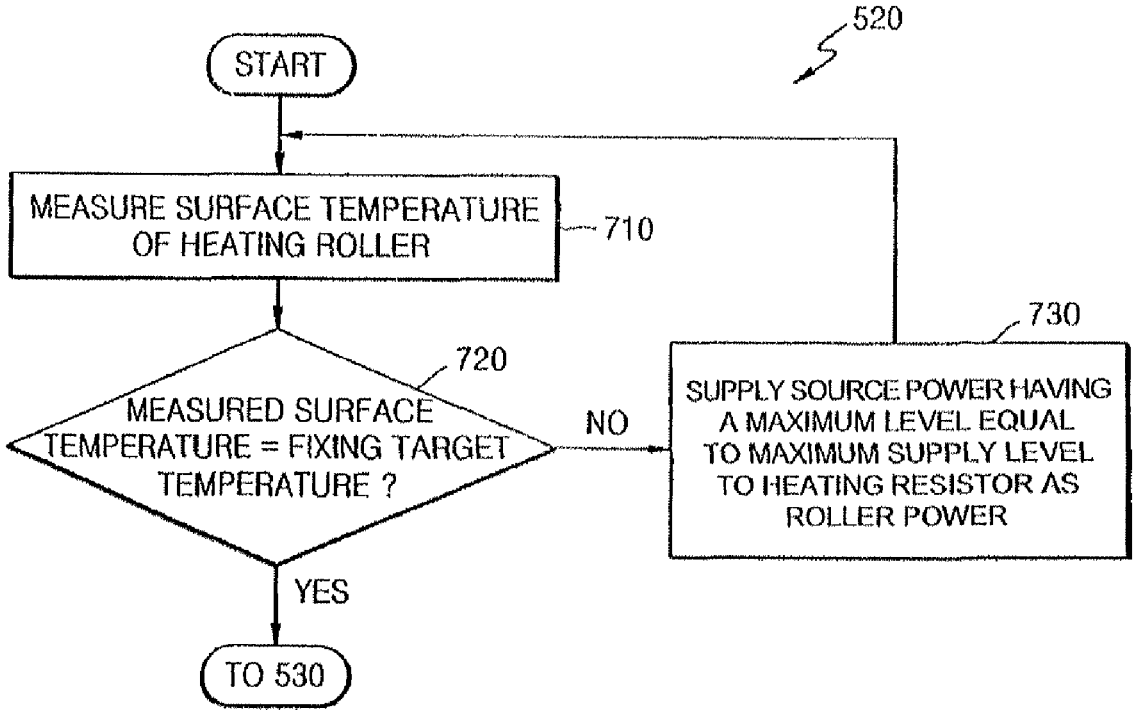
FIG. 7 is a flowchart illustrating operation 520 of the power control method of FIG. 5 according to an embodiment of the present general inventive concept.

FIG. 7 is a flowchart illustrating the operation 520 of FIG. 5 according to an exemplary embodiment of the present general inventive concept. In operations 710 to 730, the surface temperature of the heating roller is measured, and the source power having a maximum level equal to the maximum supply level is supplied to the heating resistor as the roller power until the measured surface temperature reaches the fixing target temperature.

The temperature measuring unit 220 measures the surface temperature of the heating roller (operation 710), and the second comparing unit 250 determines whether the surface temperature measured in operation 710 is equal to the fixing target temperature (operation 720).

If it is determined that the surface temperature measured in operation 710 is not equal to the fixing target temperature (operation 720), the power supply unit 210 supplies the source power having a maximum level equal to the maximum supply level to the heating resistor as the roller power (operation 730).

On the other hand, if it is determined that the surface temperature measured in operation 710 is equal to the fixing target temperature (operation 720), operation 530 is performed.

Figure 8:
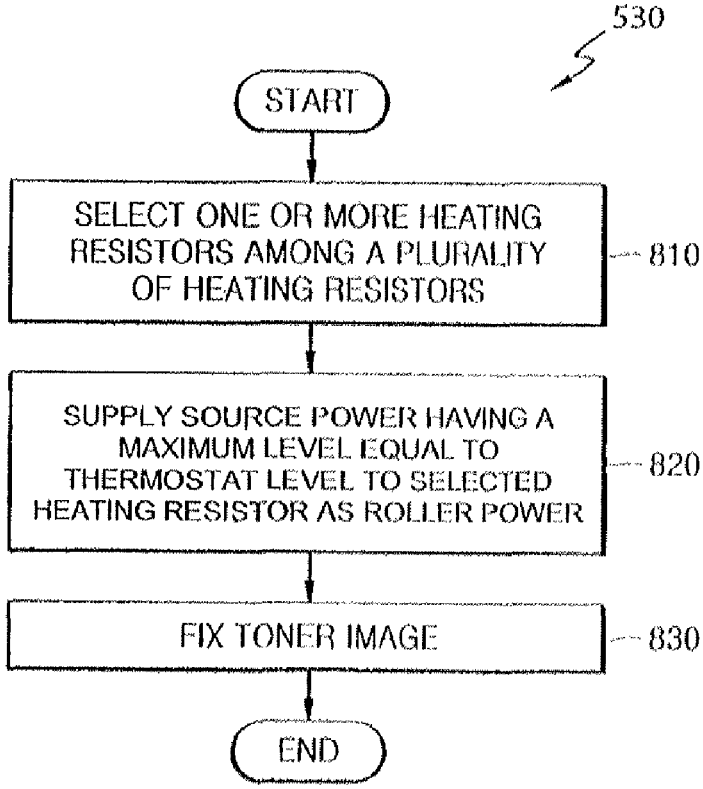
FIG. 8 is a flowchart illustrating operation 540 of the power control method of FIG. 5 according to an embodiment of the present general inventive concept.

FIG. 8 is a flowchart illustrating the operation 540 of FIG. 5 according to an exemplary embodiment of the present general inventive concept. In operations 810 to 830, the source power having a maximum level equal to the thermostat level is supplied to the heating resistor as the roller power, thereby fixing the toner image.

The non-heating control unit (not illustrated) selects one or more heating resistors among a plurality of heating resistors included in the heating roller (operation 810).

After operation 810, the power supply unit 210 supplies the source power having a maximum level equal to the thermostat level to the heating resistor selected in operation 810 as the roller power (operation 820).

After operation 820, the toner fixing unit 230 fixes the toner image onto the printing medium by using the heating roller and the pressure roller (operation 830).

Figure 9:
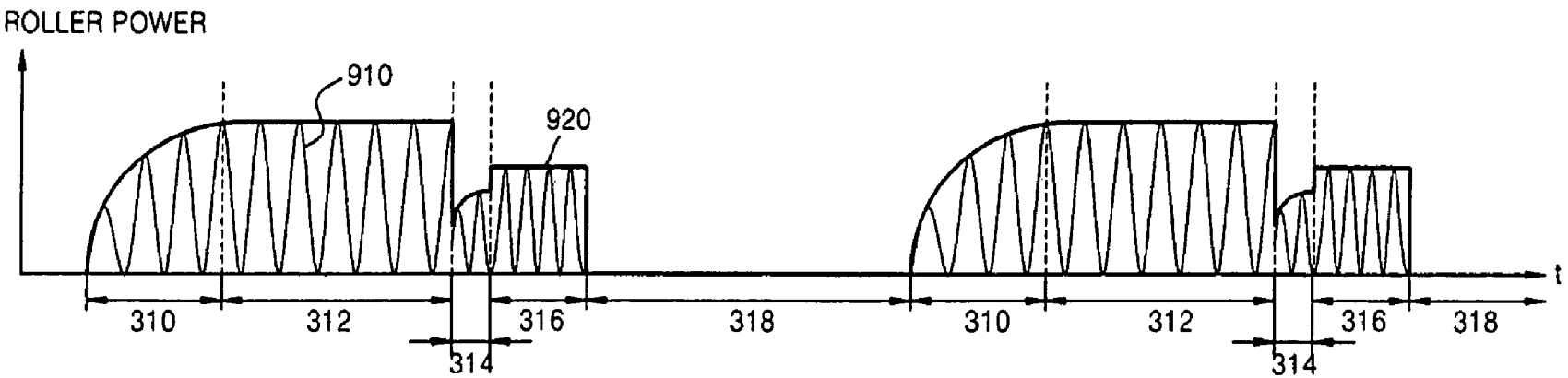
FIG. 9 is a waveform diagram illustrating a roller power supplied to a heating roller of an image forming apparatus in a standby mode according to an embodiment of the present general inventive concept.

FIG. 9 is a waveform diagram illustrating a roller power supplied to a heating roller of an image forming apparatus in a standby mode according to an embodiment of the present general inventive concept. Here, reference numerals 910 and 920 respectively indicate a roller power and an envelope of the roller power. The image forming apparatus operates in the print mode within the flicker characteristic improving section 310, the maximum power supplying section 312, the fixing property improving section 314, and the fixing section 316.

Referring to FIG. 9, the roller power 910 is not supplied to the heating resistor while the image forming apparatus is in a standby mode 318. In other words, when the image forming apparatus is switched from the standby mode 318 to the print mode the power supply unit 210 does not supply the roller power to the heating resistor of the image forming apparatus in the standby mode 318.

Accordingly, in a power control method and apparatus to control a heating roller of the present general inventive concept, when the image forming apparatus is turned on, a heating roller can be heated before the image forming apparatus is initialized, power can be supplied to the heating roller in such a way that the power is gradually increased at an early stage and a maximum power is provided after a specific time elapses. Thus, a flicker characteristic can be improved, and a surface temperature of the heating roller can rapidly reach a fixing target temperature. In addition, since a roller power is still provided in a section starting from where the surface temperature of the heating roller reaches the fixing target temperature until a printing medium is first fed, even if the printing medium is not fed right after the surface temperature of the heating roller reaches the fixing target temperature. Furthermore, in the present general inventive concept, even if the roller power is not supplied to the heating resistor of the image forming apparatus in the standby mode, the surface temperature of the heating roller can rapidly reach the fixing target temperature when the image forming apparatus is switched from the standby mode to the print mode.

Therefore, the power control method and apparatus to control the heating roller of the present general inventive concept can minimize a power consumption used in the image forming apparatus, because the roller power is not supplied to the heating resistor of the image forming apparatus in the standby mode. The general inventive concept can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A power control method to control a heating roller, in which a roller power being supplied to a heating resistor included in the heating roller is controlled in an image forming apparatus using the heating roller to fix a toner image, the power control method comprising:

supplying a source power supplied from an external source to the heating resistor as the roller power while gradually increasing a maximum level of the source power up to a specific maximum supply level;

measuring a surface temperature of the heating roller, and supplying the source power having a maximum level at the maximum supply level to the heating resistor as the roller power until the measured surface temperature reaches a specific fixing target temperature;

supplying the source power having an upper limit of the maximum level at a specific fixing property improving level to the heating resistor as the roller power until a printing medium is first fed; and fixing a toner image of print data onto the fed printing medium by using the heating roller.

2. The power control method of claim 1, wherein, in the supplying of the source power having the upper limit of the maximum level at the specific fixing property improving level, the source power is supplied to the heating resistor as the roller power while the maximum level of the source power having an upper limit at the fixing property improving level is gradually increased until the printing medium is first fed.

3. The power control method of claim 1, wherein the supplying of the source power supplied from the external source to the heating resistor as the roller power begins to be performed right after the image forming apparatus is turned on, or right after the image forming apparatus is switched from a standby mode to a print mode.

4. The power control method of claim 1, wherein:

a first control unit to control the supplying of the source power supplied from the external source to the heating resistor, the measuring of the surface temperature of the heating roller and supplying the source power having the maximum level at the maximum supply level to the heating resistor, and the supplying of the source power having the upper limit of the maximum level at the specific fixing property improving level to the heating resistor, and a second control unit to control the fixing of the toner image of print data onto the fed printing medium by using the heating roller, are separate control units in the image forming apparatus.

5. The power control method of claim 1, wherein the image forming apparatus includes the heating roller and a pressure roller, the toner image is fixed by using the heating roller and the pressure roller in the control of the fixing of the toner image of print data onto the fed printing medium by using the heating roller, and the pressure roller co-rotates with the heating roller after the image forming apparatus recognizes the pressure roller until the measuring of the surface temperature of the heating roller, and supplying the source power having the maximum level at the maximum supply level to the heating resistor is ended.

6. The power control method of claim 1, wherein the roller power is not supplied to the heating resistor of the image forming apparatus in a standby mode.

7. The power control method of claim 1, wherein the maximum supply level is the largest maximum level of the roller power that can be supplied to the heating resistor.

8. The power control method of claim 1, wherein, in the control of the fixing of the toner image of print data onto the fed printing medium by using the heating roller, the source power having a maximum level equal to a thermostat level that is lower than the maximum supply level is supplied to the heating resistor as the roller power, and the toner image is fixed by using the heating roller to which the roller power having a maximum level equal to the thermostat level is supplied, and the surface temperature of the heating roller to which the roller power is supplied has a specific similarity with respect to the fixing target temperature.

9. The power control method of claim 8, wherein the control of the fixing of the toner image of print data onto the fed printing medium by using the heating roller comprises:

selecting at least one heating resistor among a plurality of heating resistors;

supplying the source power having a maximum level equal to the thermostat level to each of the selected heating resistors as the roller power; and fixing the toner image onto the printing medium by using the heating roller, and wherein the roller power is not supplied to the heating resistors not selected.

10. The power control method of claim 1, further comprising:

determining whether print data is received while a specific standby mode determining time elapses after the control of the fixing of the toner image of print data onto the fed printing medium by using the heating roller is performed, and switching the image forming apparatus to a standby mode if the print data is not received when the standby mode determining time elapses after the control of the fixing of the toner image of print data onto the fed printing medium by using the heating roller is performed; and (f) determining whether print data is received after the image forming apparatus is switched to the standby mode in the determining of whether the print data is received while the specific standby mode determining time elapses, and switching the image forming apparatus to a print mode and proceed to the supplying of the source power supplied from the external source to the heating resistor if the print data is received after the image forming apparatus is switched to the standby mode in the determining of whether the print data is received while the specific standby mode determining time elapses.

11. The power control method of claim 1, wherein the heating resistor has a variable characteristic in which resistance thereof is determined in proportion to the heating resistor's temperature equal to or less than a threshold temperature.

12. A power control apparatus to control a heating roller, in which a roller power being supplied to a heating resistor included in the heating roller is controlled in an image forming apparatus using the heating roller and to fix a toner image, the power control apparatus comprising:

a power supply unit which gradually increases a maximum level of a source power supplied from an external source in response to a first or second warm-up indication signal, outputs the source power to the heating resistor as the roller power, outputs the source power having a maximum level equal to a specific maximum supply level to the heating resistor as the roller power in response to a third warm-up indication signal, and outputs the source power having an upper limit of a maximum level equal to a specific fixing property improving level to the heating resistor as the roller power in response to a fifth warm-up indicating signal;

a temperature measuring unit which measures a surface temperature of the heating roller in response to the third warm-up indication signal;

a toner fixing unit to feed a printing medium and to fix a toner image of given print data onto the fed printing medium by using the heating roller in response to a fixing indication signal;

a first comparing unit which compares the increased maximum level with the maximum supply level, and generates the second or third warm-up indication signal according to the comparison result obtained by the first comparing unit;

a second comparing unit which compares the measured surface temperature with a specific fixing target temperature, and generates one of the third warm-up indication signal and the fixing indication signal according to the comparison result obtained by the second comparing unit; and a paper feed detecting unit which checks whether the printing medium is fed in response to the fixing indication signal, and generates the fifth warm-up indication signal in response to the check result, wherein the first warm-up indication signal is generated right after the image forming apparatus is turned on, or right after the image forming apparatus is switched from a standby mode to a print mode.

13. The power control apparatus of claim 12, wherein the image forming apparatus includes the heating roller and a pressure roller, the toner fixing unit allows the heating roller to co-rotate with the pressure roller in response to a fourth warm-up indication signal, and fixes the toner image onto the printing medium by using the heating roller and the pressure roller in response to the fixing indication signal, and the fourth warm-up indication signal is generated right after the image forming apparatus recognizes the pressure roller.

14. The power control apparatus of claim 12, wherein the power supply unit supplies no power to the heating roller as the roller power in response to a power supply interruption signal, and the power supply interruption signal is generated while the image forming apparatus is in the standby mode.

15. The power control apparatus of claim 12, further comprising:

a first unit to control the power supply unit; and a second unit to control the toner fixing, wherein the first and second units are separate units in the image forming apparatus.

16. The power control apparatus of claim 12, wherein the fixing indication signal is generated according to one of a comparison result obtained by the second comparing unit and while the toner fixing unit operates.

17. An image forming apparatus including a heating roller, in which a roller power being supplied to a heating resistor included in the heating roller is controlled in the image forming apparatus to fix a toner image, the image forming apparatus comprising:

a power supply unit which gradually increases a maximum level of a source power supplied from an external source in response to a first or second warm-up indication signal, outputs the source power to the heating resistor as the roller power, outputs the source power having a maximum level equal to a specific maximum supply level to the heating resistor as the roller power in response to a third warm-up indication signal, and outputs the source power having an upper limit of a maximum level equal to a specific fixing property improving level to the heating resistor as the roller power in response to a fifth warm-up indicating signal;

a temperature measuring unit which measures a surface temperature of the heating roller in response to the third warm-up indication signal;

a toner fixing unit to feed a printing medium and to fix a toner image of given print data onto the fed printing medium by using the heating roller in response to a fixing indication signal;

a first comparing unit which compares the increased maximum level with the maximum supply level, and generates the second or third warm-up indication signal according to the comparison result obtained by the first comparing unit;

a second comparing unit which compares the measured surface temperature with a specific fixing target temperature, and generates the third warm-up indication signal or the fixing indication signal according to the comparison result obtained by the second comparing unit; and a paper feed detecting unit which checks whether a printing medium is fed in response to the fixing indication signal, and generates the fifth warm-up indication signal in response to the check result, wherein the first warm-up indication signal is generated right after the image forming apparatus is turned on, or right after the image forming apparatus is switched from a standby mode to a print mode.

18. The image forming apparatus of claim 17, further comprising a pressure roller, wherein the toner fixing unit allows the heating roller to co-rotate with the pressure roller in response to a fourth warm-up indication signal, and fixes the toner image onto the printing medium by using the heating roller and the pressure roller in response to the fixing indication signal, and the fourth warm-up indication signal is generated right after the image forming apparatus recognizes the pressure roller.

19. The image forming apparatus of claim 17, wherein the power supply unit supplies no power to the heating roller as the roller power in response to a power supply interruption signal, and the power supply interruption signal is generated while the image forming apparatus is in the standby mode.

20. The image forming apparatus of claim 17, wherein a first unit to control the operations of the power supply unit and a second unit to control the operations of the toner fixing unit are separate units in the image forming apparatus.

21. The image forming apparatus of claim 17, wherein the fixing indication signal is generated according to one of a comparison result obtained by the second comparing unit and while the toner fixing unit operates.

22. A computer-readable medium having embodied thereon a computer program to execute a power control method to control a heating roller, in which a roller power supplied to a heating resistor included in the heating roller is controlled in an image forming apparatus using the heating roller to fix a toner image, the power control method comprising:

gradually increasing a maximum level of a source power supplied from an external source up to a specific maximum supply level, and supplying the source power to the heating resistor as the roller power;

measuring a surface temperature of the heating roller, and supplying the source power having a maximum level equal to the maximum supply level to the heating resistor as the roller power until the measured surface temperature reaches a specific fixing target temperature;

supplying the source power having an upper limit of the maximum level equal to a specific fixing property improving level to the heating resistor as the roller power until a printing medium is first fed; and fixing a toner image of print data onto the fed printing medium by using the heating roller.

23. A power control apparatus usable in an image forming apparatus, to control heating resistors of a heating roller to fix a toner image, the power control apparatus comprising:

a power supply unit to receive an external power source and supply a roller power to the heating resistors;

a temperature measuring unit to measure a surface temperature of the heating roller;

a first comparing unit to compare the roller power supplied to the heating resistors to a maximum supply level and to generate one of a second warm-up indication signal and a third warm-up indication signal, the second warm-up indication signal being generated if the roller power supplied is below the maximum supply level, and the third warm-up indication signal being generated if the roller power supplied is at the maximum supply level; and a second comparing unit to compare the measured surface temperature of the heating roller to a predetermined target fixing temperature, and to generate one of the third warm-up indication signal and a fixing indication signal, the third warm-up indication signal being generated if the measured surface temperature of the heating roller is less than the target fixing temperature, and the fixing indication signal being generated if the measured surface temperature of the heating roller is at the target fixing temperature, wherein the power supply unit:

gradually increases a maximum level of the source power supplied as the roller power in response to one of a first warm-up indication signal and the second warm-up indication signal, the first warm-up indication signal being generated after one of a first power on of the image forming apparatus and a switch of the image forming apparatus from a standby mode to a print mode, supplies the roller power at a current maximum level of the source power in response to one of the third warm-up indication signal and the fixing indication signal, and does not supply roller power to the heating resistors in response to a power interruption indication signal, the power interruption indication signal being generated when the image forming apparatus is in standby mode.

24. The power control apparatus of claim 23, further comprising:

a toner fixing unit, comprising the heat roller and a pressure roller, to co-rotate the heat and pressure rollers in response to a fourth indication signal, and to feed a printing medium and to fix the toner image on the printing medium in response to the fixing indication signal, wherein the fourth indication signal is generated after the image forming apparatus recognizes the pressure roller, and the toner fixing unit does not respond to the fixing indication signal if the image forming apparatus has not received a printing order.

25. The power control apparatus of claim 24, further comprising:

a paper feed detecting unit to detect whether [the printing medium is fed and to generate a fifth warm-up indication signal if the printing medium is not fed in response to the fixing indication signal, wherein the power supply unit supplies the source power as the roller power at a fixing property improving level to the heat resistors in response to the fifth warm-up indication signal.

26. The power control apparatus of claim 25, wherein the power supply unit is controlled by a first unit separate from one or more second control units to control the paper feed detecting unit and the toner fixing unit in the image forming apparatus.

27. The power control apparatus of claim 26, wherein the power supply unit supplies the roller power in response to one of the first, second, and third warm-up indication signals, the fixing indication signal, and the power interruption indication signal before the one or more second control units are initialized.

28. The power control apparatus of claim 23, wherein the image forming apparatus switches from the standby mode to the print mode after receiving a printing order.

29. A power control apparatus usable in an image forming apparatus, to control a heating roller to fix a toner image, the power control apparatus comprising:

a power supply unit to receive a source power from an external power source and supply a roller power to the heating roller; and a temperature measuring unit to measure a surface temperature of the heating roller, wherein the power supply unit performs one of gradually increasing a maximum level of the source power supplied as the roller power, supplying the roller power at a current maximum level of the source power, and not supplying roller power to the heating roller according to a measured level of the roller power supplied and a surface temperature of the heating roller.

30. The power control apparatus of claim 29, wherein the power supply unit is controlled by a first control unit separate from one or more second control units to initialize the image forming apparatus.

* * * * *